US009036855B2

(12) United States Patent
Shah

(10) Patent No.: US 9,036,855 B2
(45) Date of Patent: May 19, 2015

(54) ROTARY USER INTERFACE FOR HEADPHONES

(71) Applicant: Bose Corporation, Framingham, MA (US)

(72) Inventor: Nihar Shah, Boston, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/013,415

(22) Filed: Aug. 29, 2013

(65) Prior Publication Data

US 2015/0063586 A1 Mar. 5, 2015

(51) Int. Cl.
*H04R 25/00* (2006.01)
*H04R 1/10* (2006.01)

(52) U.S. Cl.
CPC ..... *H04R 1/1041* (2013.01)

(58) Field of Classification Search
CPC ..... H04R 1/1041; H04R 1/10; H04M 1/05; H04M 1/6058
USPC ..... 381/370, 371, 374, 376, 378, 384, 74; 379/430; 455/575.2
See application file for complete search history.

(56) References Cited

U.S. PATENT DOCUMENTS

2006/0147052 A1 7/2006 Wikel et al.
2009/0268935 A1* 10/2009 Dillinger ..... 381/371
2012/0051576 A1* 3/2012 Shiomi et al. ..... 381/374
2012/0195455 A1* 8/2012 Chiba et al. ..... 381/374
2012/0243700 A1* 9/2012 Jenkins ..... 381/72

FOREIGN PATENT DOCUMENTS

EP 2160046 A1 3/2010

OTHER PUBLICATIONS

International Search Report and Written Opinion dated Oct. 20, 2014 for International application No. PCT/US2014/049725.

Jabra: "Jabra Revo Wireless User's Manual", Jabra Revo Wireless User's Manual, Apr. 1, 2013, pp. 1-19, XP055144525, Bellerup, Denmark; Retrieved from the Internet: URL: http://www.jabra.com/-/media/ProductDocumentation/Jabra REVO Wireless/UserManuals/Revo Wireless UM US.pdf [retrieved on Oct. 6, 2014], pp. 3-13.

* cited by examiner

*Primary Examiner* — Tuan D Nguyen

(57) ABSTRACT

A headphone includes a housing, a loudspeaker located inside the housing, a cushion coupled to the housing and arranged to acoustically couple the headphone to a user's ear, electronics electrically coupled to the loudspeaker, and a rotatable ring coupled to the housing and surrounding a central portion of the housing, rotation of the ring providing a user input to the electronics. The headphone may include a touch sensor detecting contact with the ring by an external element and providing an input signal to the electronics, the electronics reacting to the input signal based on the direction and extent of contact by the external element moving along the ring.

12 Claims, 8 Drawing Sheets

ROTARY USER INTERFACE FOR HEADPHONES

BACKGROUND

This disclosure relates to a rotary user interface for headphones.

Headphones may have a number of features requiring a user interface. For example, powered headphones, such as active noise reduction (ANR) headphones or headphones with wireless radio receivers, need on-off switches. Headphones may also have mode or source control switches, and volume controls. Typically, the user interfaces used for such switches on headphones are implemented using sliding switches and push buttons. A disadvantage of many such switches and buttons is that operating them applies force inward on the headphone, that is, towards the user's head, which can be uncomfortable and may interfere with the acoustics of the headphone's fit on the head.

SUMMARY

In general, in one aspect, a headphone includes a housing, a loudspeaker located inside the housing, a cushion coupled to the housing and arranged to acoustically couple the headphone to a user's ear, electronics electrically coupled to the loudspeaker, and a rotatable ring coupled to the housing and surrounding a central portion of the housing, rotation of the ring providing a user input to the electronics.

Implementations may include one or more of the following, in any combination. The rotatable ring may be exposed to allow user contact along its entire circumference. The rotatable ring may be coupled to an encoder, the encoder converting rotation of the ring to an electrical signal provided to the electronics. The encoder may require a first amount of torque to be applied to the rotatable ring to operate, and the encoder may transmit a second amount of torque to the housing in response to the first amount of torque being applied to the rotatable ring, the second amount of torque being less than an amount of torque that can damped by the cushion and thereby not transmitted to the users'head. The housing may be characterized by a first axis along which the headphone applies pressure to the head of the user and about which the rotatable ring rotates, manual rotation of the ring not requiring application of external force to the ring in a direction parallel to the first axis. The housing may be characterized by a first axis along which the headphone applies pressure to the head of the user, and the rotatable ring may protrude from a surface of the housing, such that the user can rotate the ring by gripping it in a direction perpendicular to the first axis or by pressing on the ring in a direction parallel to the first axis.

The user input provided by the ring may include an on/off signal. The user input provided by the ring may include a volume adjustment signal. The user input provided by the ring may include a mode selection signal. The user input provided by the ring may control two or more different characteristics of the headphones. A touch sensor may be coupled to the rotatable ring, the user input provided by ring controlling a first characteristic of the headphones if the touch sensor indicates that the ring was touched in a first region of the ring, and the user input provided by the ring controlling a second characteristic of the headphones if the touch sensor indicates that the ring was touched in a second region of the ring. The first and second regions of the ring may be defined relative to the housing, and may not vary relative to the housing as the ring is physically rotated.

The rotatable ring may be a first rotatable ring, with a second rotatable ring coupled to the housing and surrounding a second central portion of the housing, rotation of the second rotatable ring providing a second user input to the electronics, the first rotatable ring and the second rotatable ring positioned such that they partially overlap, and the housing covering a first portion of the first rotatable ring that overlaps the second rotatable ring and a first portion of the second rotatable ring that overlaps the first rotatable ring, such that second, non-covered portions of the first and second rotatable rings appear to form an elongated circle. The electronics may cause the loudspeaker to output audible sounds in response to rotation of the ring.

In general, in one aspect, a headphone includes a housing, a loudspeaker located inside the housing, a cushion coupled to the housing and arranged to acoustically couple the headphone to a user's ear, electronics electrically coupled to the loudspeaker, a ring coupled to the housing and surrounding a central portion of the housing, and a touch sensor detecting contact with the ring by an external element and providing an input signal to the electronics, the electronics reacting to the input signal based on the direction and extent of contact by the external element moving along the ring.

Implementations may include one or more of the following, in any combination. The ring may be exposed to allow user contact along its entire circumference. The housing may be characterized by a first axis along which the headphone applies pressure to the head of the user, which the ring rotates about, with contact with the ring sufficient to be detected by the touch sensor not requiring application of external force to the ring in a direction parallel to the first axis. The electronics may modify a first characteristic of the headphones if the touch sensor indicates that the ring was touched in a first region of the ring, and the electronics may modify a second characteristic of the headphones if the touch sensor indicates that the ring was touched in a second region of the ring. The ring may be shaped as an oval.

Advantages include providing an intuitive interface that is comfortable to use. Avoiding inward pressure on the headphone avoids discomfort and minimizes effects on the fit of the headphone to the head.

All examples and features mentioned above can be combined in any technically possible way. Other features and advantages will be apparent from the description and the claims.

DESCRIPTION

Figure 1:
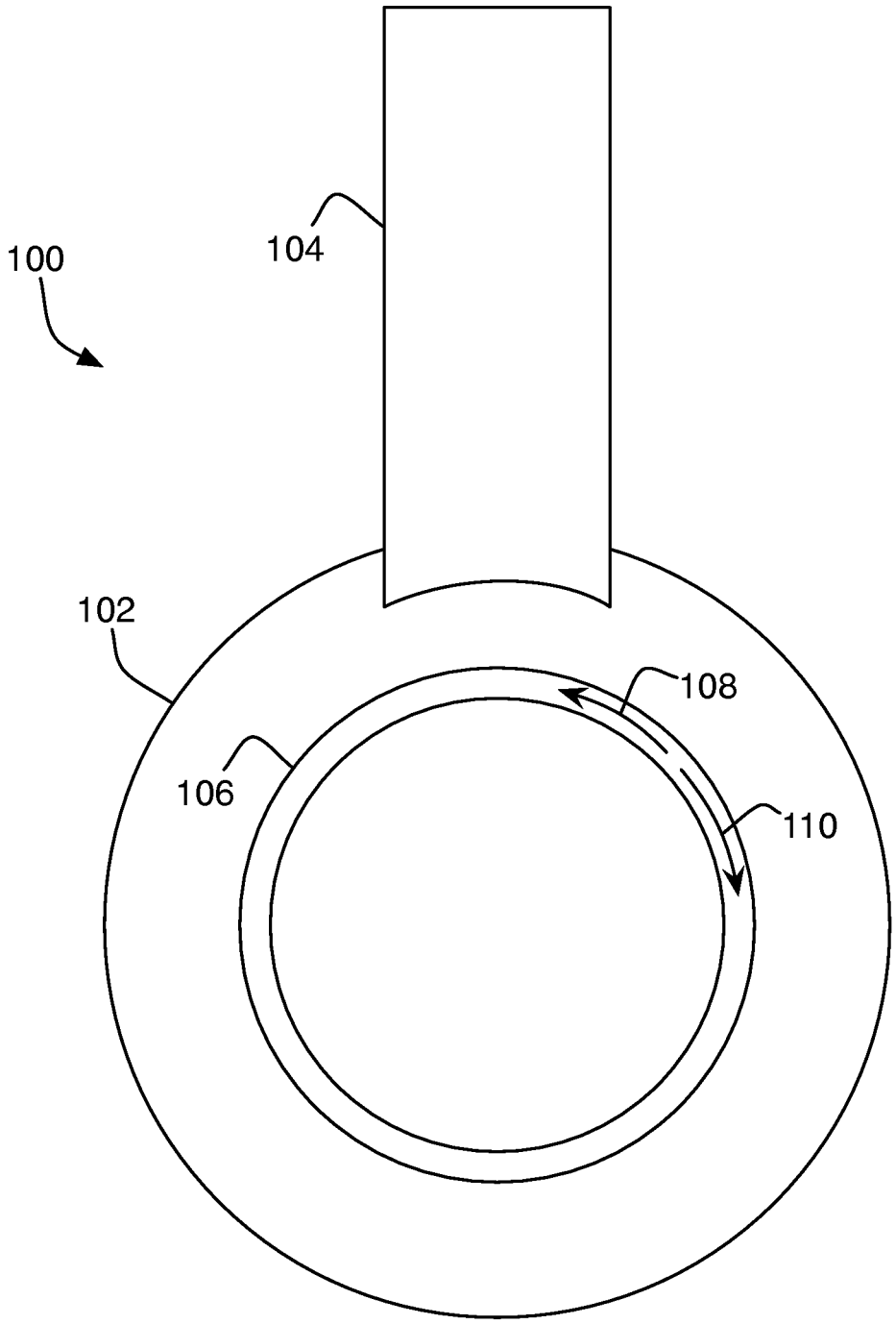
FIGS. 1 and 6 show a headphone having a rotary user interface.

As shown in FIG. 1, a user interface is provided on a set of headphones by providing a ring that rotates around a portion of the headphones. In particular, the headphones of FIG. 1 have at least one ear cup 102. Typically a second ear cup (not shown) is connected to the first ear cup by a headband 104. In some examples, rather than a second ear cup, a headset may include a pad for resting on the user's head opposite the one ear cup, keeping the user's second ear free. A ring 106 mounted on the ear cup 102 is free to rotate in two directions, shown by arrows 108 and no. Rotating the ring provides one or more user inputs to electronics in the headphones, as described in more detail below.

The geometry and materials of the ear cup and ring will determine what forces a user must apply to the ring and ear cup to rotate the ring. It is generally desirable that a user not be encouraged to apply force against the ear cup in a way that changes the fit of the ear cup on the user's head, or that applies pressure to the user's head via the ear cup. For convenience, we refer to forces against the side of the head, through the ear cup, and motion in that direction as being axial, forces or motion across the face of the ear cup as radial, and forces or motion in the direction of the ring's rotation (i.e., applying torque to the ring or ear cup around an axis through the ear cup and head) as tangential.

Figure 2:
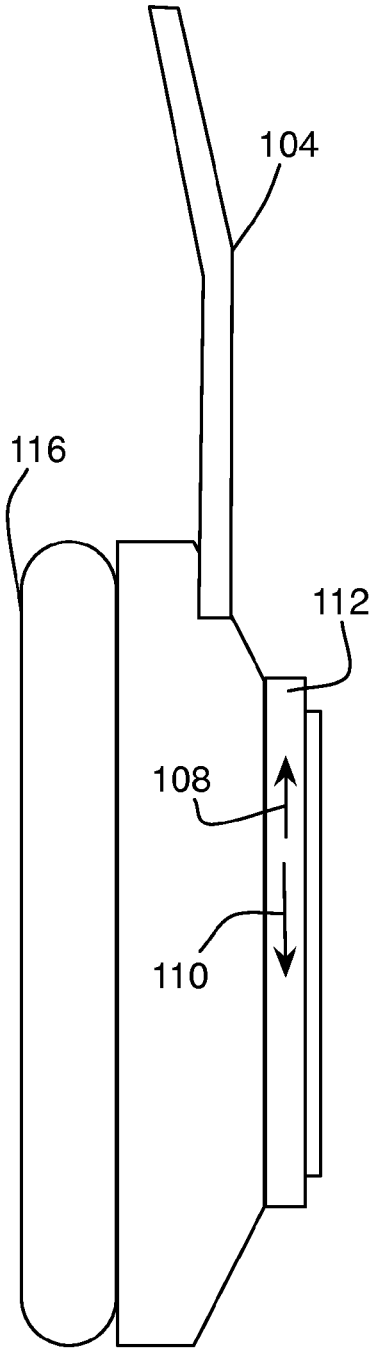
FIGS. 2 and 3 show side views of embodiments of the headphones of FIGS. 1 and 6.
Figure 3:
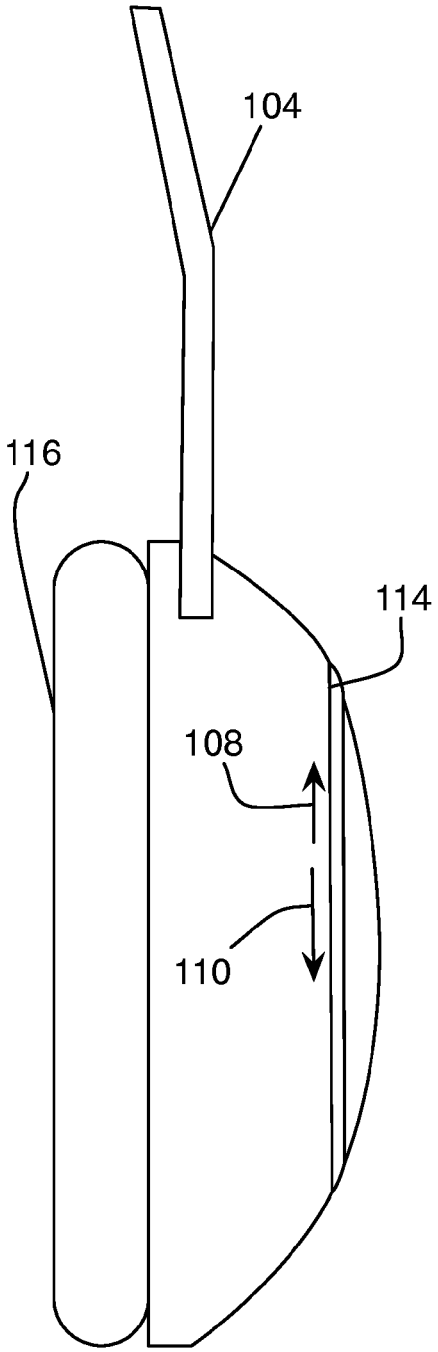
Figure 4:
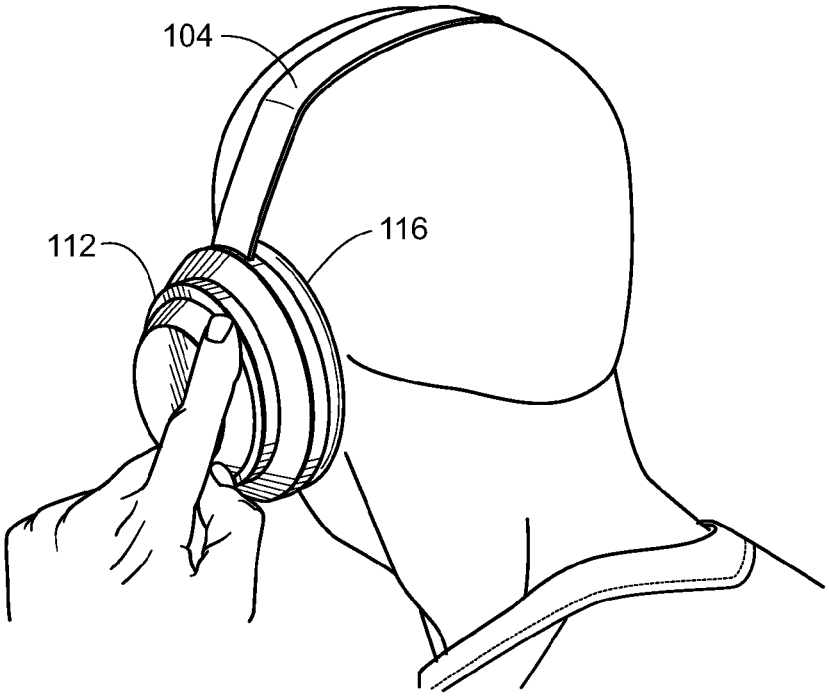
FIGS. 4 and 5 show perspective views of the embodiments of FIGS. 2 and 3, as worn by a user.
Figure 5:
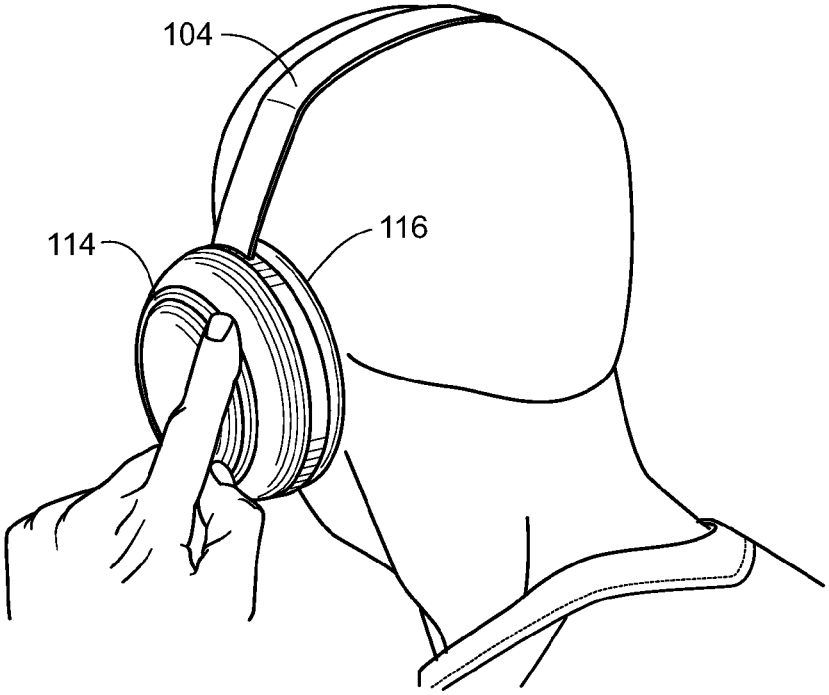

FIGS. 2 and 3 show side views of two possible implementations of the headphones of FIG. 1. FIGS. 4 and 5 show perspective views of the same implementations in use, with the user's fingers shown interacting with the headphones. In FIGS. 2 and 4, the ring 112 is rectangular in cross-section and projects outward from a sloping or curved surface of the ear cup 102. Such a ring may be manipulated by the user by placing fingers on opposite sides of the ring, squeezing the ring, and then rotating it. By applying equal force to either side of the ring, no net axial or radial force needs to be applied to the ear cup. If the mechanism used to detect the rotation of the ring transfers little of the torque applied to the ring to the ear cup, then the ring can be rotated without significant tangential force being transferred to the ear cup or the user's head. The raised profile of the ring, relative to the surface of the ear cup, allows the user to interact with the ring on either the top or the side of the ring, providing mor surface area for contact without increasing the diameter fo the ring.

If the ring's resistance to rotation is low enough, less force must be applied to grip it, and it may even be rotated with a single finger, that is, friction between the finger and the ring may be high enough for tangential movement of a finger to rotate the ring without requiring the user to apply significant radial or axial force to the ring. Friction between the user's finger and the ring does depend on some axial or radial force being applied to the ring, but this force may be low enough that it is absorbed by the compliance of the headphone's cushion 116 and not felt by the user.

In FIGS. 3 and 5, the ring 114 is flush to the contour of the ear cup, providing a more streamlined appearance. Such a ring may not be easily gripped to rotate like the ring of FIG. 2, but as long as the torque required to rotate the ring is low enough, the user may rotate the ring by lightly touching the ring with a finger, friction between the finger and the ring being enough to rotate the ring without having to pinch the ring from opposite sides. In other examples, the ring is a capacitive sensor, and does not actually rotate at all. Rather, electronics in the ear cup detect that the ring has been touched, and that the touch is moving along the ring in a tangential direction. Such touch may be interpreted by the headphone electronics in the same way as physical rotation of the ring, as described below. In this case, no force may be required between the finger and the ring—a capacitive sensor may detect a finger moving near the ring without even physically touching it.

In addition to detecting direction and extent of the rotation, the ring may provide some tactile feedback to the user, and may provide more than one control function based on how far it is turned. In one example, the ring rotates freely in both directions, turning the volume up or down, over a range of angles, but has stops at upper and lower limits. If the user provides additional force at one of the stops, the ring may move past it to a rest position where the ring is no longer free to rotate until such force is again applied. The rest position may be simply "off", especially when it is provided at end of rotation in the direction associated with lower volume, or it may provide more advanced features, such as muting an audio source or locking out other controls. Tactile feedback may include a series fo detents, such that as the ring is rotated, the user feels the series of detents to get a sense of progress. The detents may correspond to increments of whatever setting the ring is controlling, or may be arbitrary.

Figure 6:
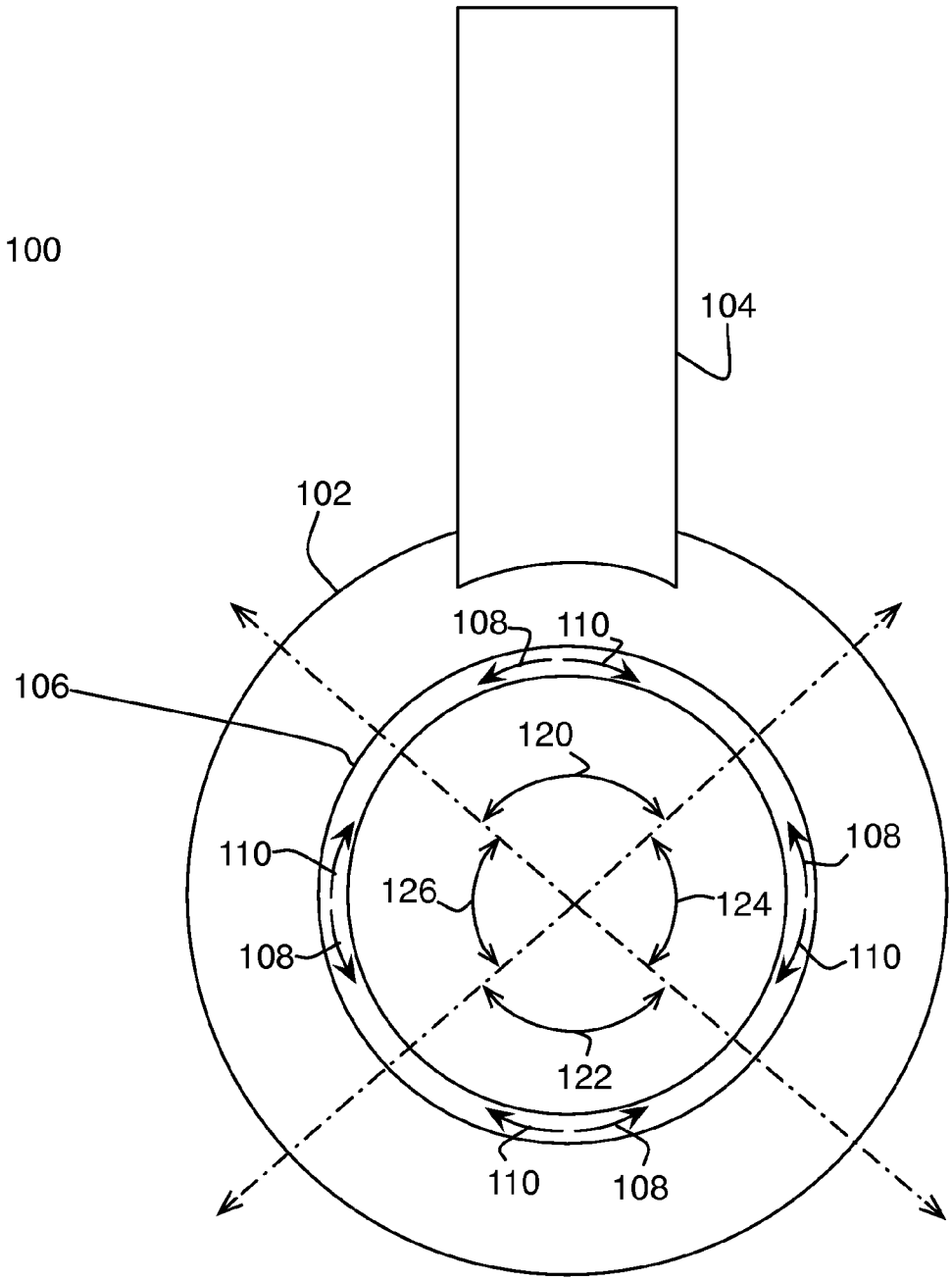

FIG. 6 shows a further implementation made possible with sensors that know where the ring has been touched. The ring is divided into four regions, 120, 122, 124, and 126. The ring 106 may be rotated as before, but where it was touched to accomplish the rotation may be considered as part of the user interface response to the rotation. The regions are defined relative to the ear cup 102 itself, not the ring 106, as the user wearing the headphones will not generally be aware of the starting position of the ring, and the ring may not even have visual indications of its position. The interface of FIG. 6 may be used with the non-moving, fully capacitive ring mentioned above, with the location where a touch-and-swipe motion started determining how the input is interpreted. While the four regions of FIG. 6 are shown as being equal in extent, 90° each, they may be different, and there may be more or fewer than four regions. There may also be dead spaces, such that rotation that starts with a touch in a dead space does not initiate any user interface response. The regions may also overlap, with the direction of motion away from the point of first contact determining which region is used as input.

Figure 7:
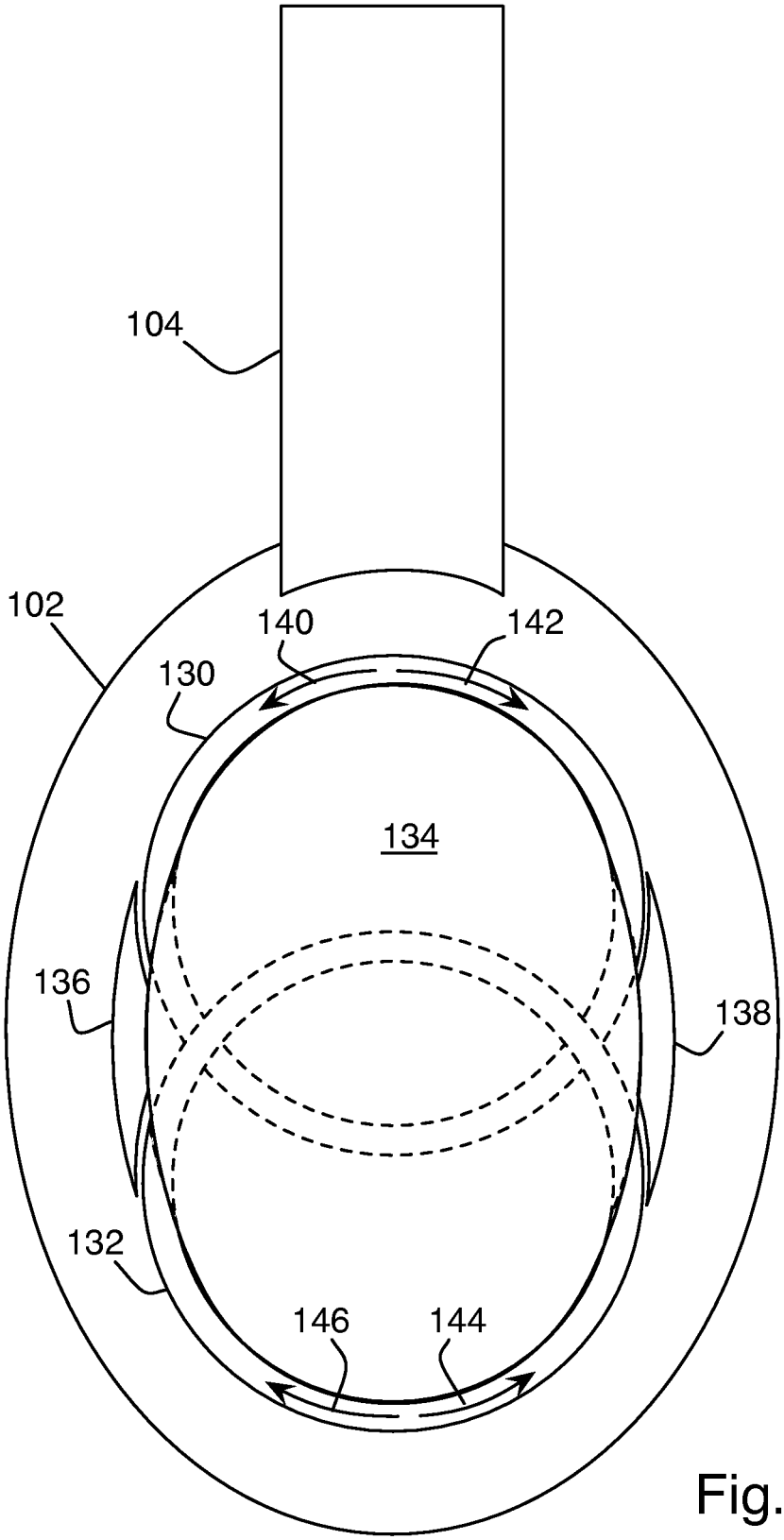
FIG. 7 shows a headphone having a two-ring rotary user interface.

FIG. 7 shows another implementation, where two overlapping rings 130 and 132 are provided, to control two different features of the headphones. FIG. 7 also shows a design for partially concealing the two rings and making them look like ends of a single elliptical trim ring. The two rings overlap, with a cover plate 134 hiding the overlapping portions, and decorative elements 136 and 138 completing the visual line between the exposed portions of the rings. Although not mathematically an ellipse, the net visual effect may be that a single elliptical ring is provided. As with the multi-region ring of FIG. 6, the user may simply regard the position where he touches the ring as determining its function, rather than treating the two rings as "top" and "bottom" rings. Alternatively, the two rings' functionality may be kept clearly separate, but in an integrated physical design. The decorative elements 136 and 138 may also be push button controls for additional features, though it would be preferable that they be capacitive, so that no significant axial force needs to be applied to activate them. In any of these implementations, additional controls may be provided elsewhere on the ear cup, as part of the ring interface or separate from it.

Figure 8:
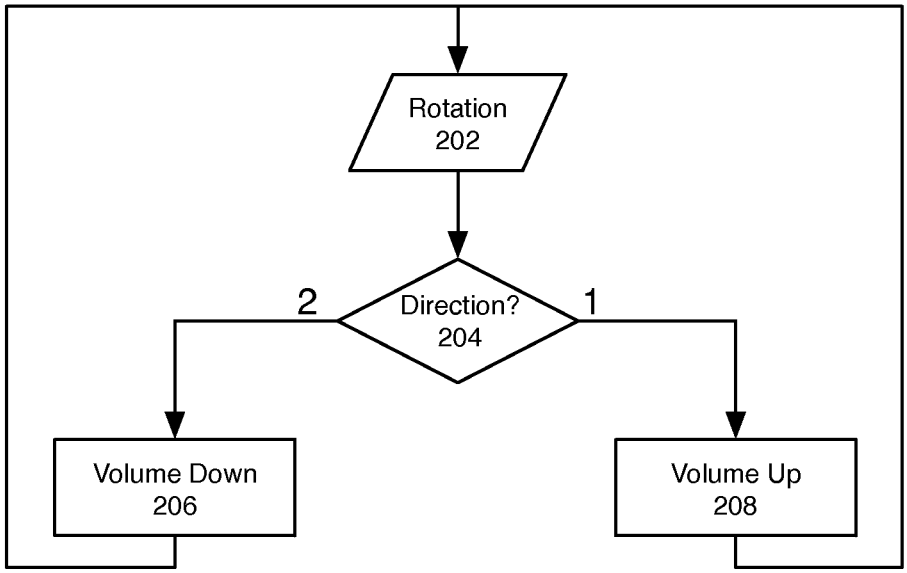
FIGS. 8 through 11 show flow charts.

Flow charts in FIGS. 8 through 11 show how the input provided by the examples above may be interpreted by the headphone's electronics. In FIG. 8, rotation input 202 is evaluated (204) for direction. If it is counter-clockwise, the volume is decreased (206), and if it is clockwise, the volume is increased (208). Note that references here to "clockwise" and "counter-clockwise" are arbitrary—the actual directions that users associate with different motions may vary with context. Users might also consider their movements to be up and down or forward and back, rather than considering their circular direction.

Figure 9:
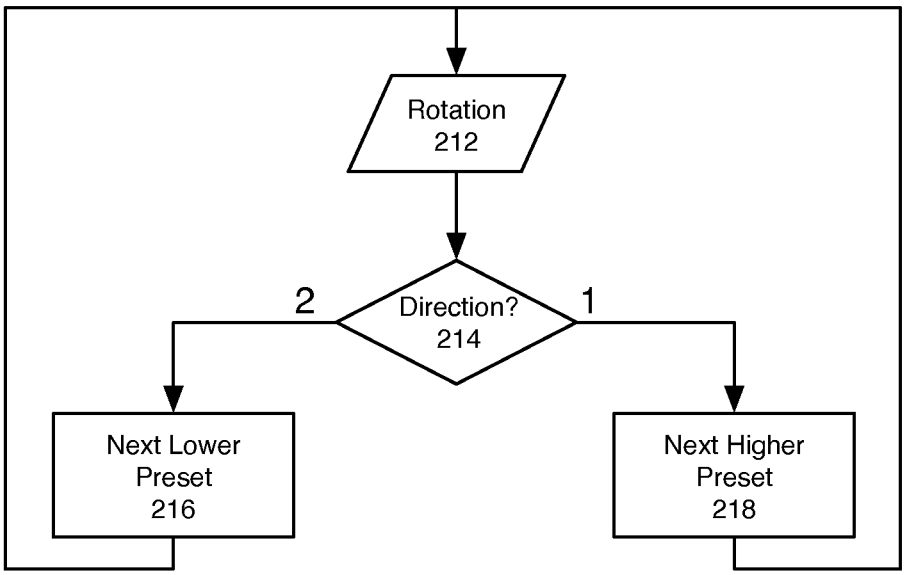
Figure 10:
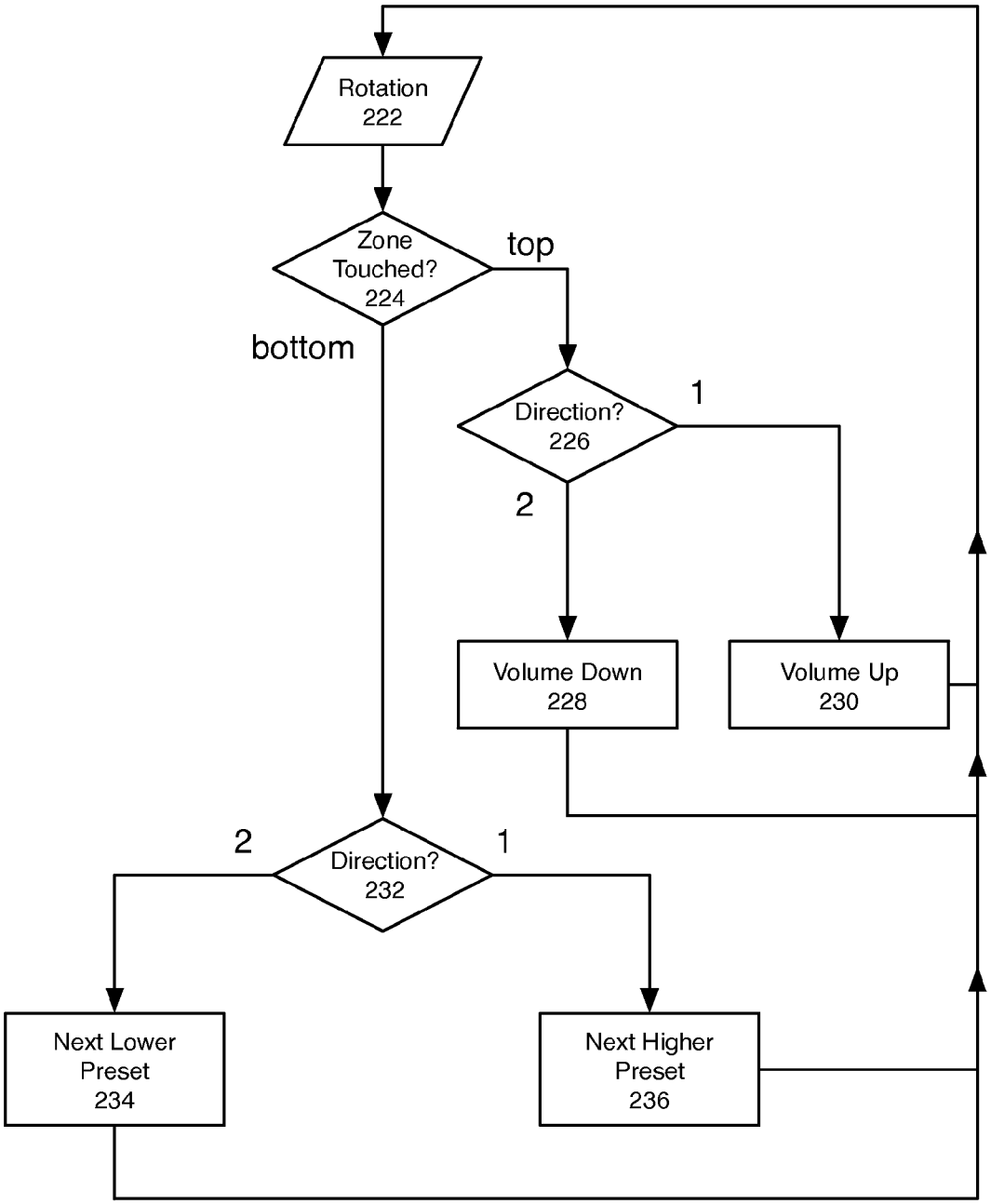
Figure 11:
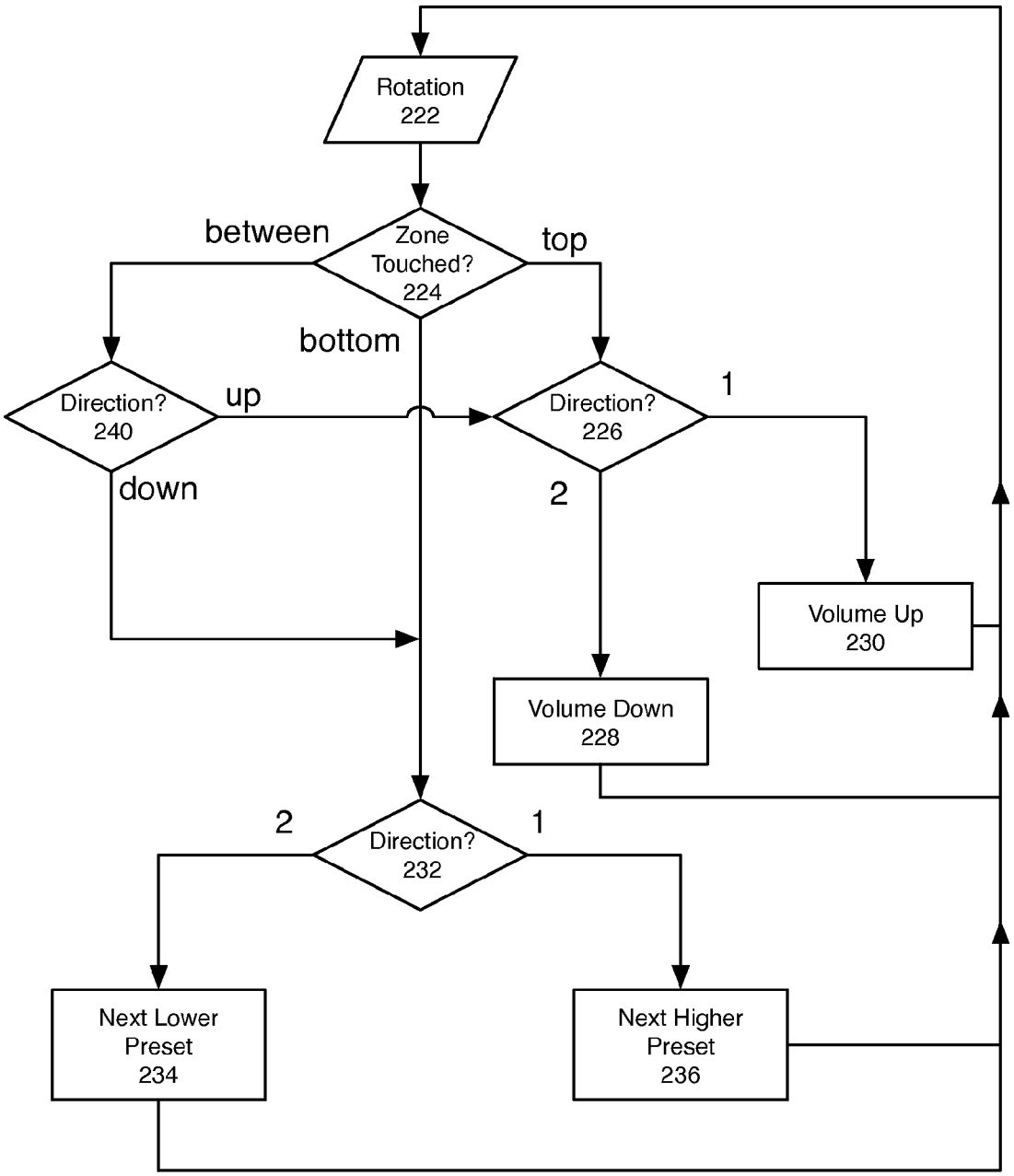

Similarly in FIG. 9, where the ring is used to select a preset input (e.g., a radio station or a playlist), rotation input 212 is evaluated (214) for direction. If it is a first direction, e.g., counter-clockwise, the next lower preset is selected (216), and if it is the other direction, e.g., clockwise, the next higher preset is selected (218). FIG. 10 shows the interpretation of rotation input with additional information about where the ring was touched. Rotation input 222 is first evaluated for touch zone (224). If the top of the ring was touched, then the volume is controlled (226, 228, 230) as in FIG. 8. If the bottom of the ring was touched, then the preset is selected (232, 234, 236) as in FIG. 9. Again, references to "top" and "bottom" are arbitrary, and any location may be used based on the users' or designers' preferences. FIG. 11 adds the additional option of allowing the zones to overlap. In this case, if the touch is between the zones, then the direction is evaluated (240) to determine if the rotation is up or down from the point of touch. If the motion is upward, then the "top" branch for selecting volume is used. If the motion is downward, then the "bottom" branch for selecting presets is used. As mentioned above, there could be more than two zones, with the flow charts expanded accordingly. In some examples, audible prompts may be generated inside the headphones to indicate to the user what setting has been changed. These may include, for example, speaking the name of a selected feature, or making a ticking or dinging noise that increases with level as the volume is increased.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A headphone, comprising:

a housing;

a loudspeaker located inside the housing;

a cushion coupled to the housing and arranged to acoustically couple the headphone to a user's ear;

electronics electrically coupled to the loudspeaker;

a rotatable ring coupled to the housing and surrounding a central portion of the housing, rotation of the ring providing a user input to the electronics which controls two or more different characteristics of the headphones; and a touch sensor coupled to the rotatable ring, wherein the user input provided by ring controls a first characteristic of the headphones if the touch sensor indicates that the ring was touched in a first region of the ring, and the user input provided by the ring controls a second characteristic of the headphones if the touch sensor indicates that the ring was touched in a second region of the ring.

2. The headphone of claim 1, wherein the rotatable ring is exposed to allow user contact along its entire circumference.

3. The headphone of claim 1, wherein the rotatable ring is coupled to an encoder, the encoder converting rotation of the ring to an electrical signal provided to the electronics.

4. The headphone of claim 3, wherein the encoder requires a first amount of torque to be applied to the rotatable ring to operate, and the encoder transmits a second amount of torque to the housing in response to the first amount of torque being applied to the rotatable ring, the second amount of torque being less than an amount of torque that can damped by the cushion and thereby not transmitted to the users' head.

5. The headphone of claim 1, wherein the housing is characterized by a first axis along which the headphone applies pressure to the head of the user;

the rotatable ring rotates about the first axis; and manual rotation of the ring does not require application of external force to the ring in a direction parallel to the first axis.

6. The headphone of claim 1, wherein the housing is characterized by a first axis along which the headphone applies pressure to the head of the user; and the rotatable ring protrudes from a surface of the housing, such that the user can rotate the ring by gripping it in a direction perpendicular to the first axis or by pressing on the ring in a direction parallel to the first axis.

7. The headphone of claim 1, wherein the user input provided by the ring comprises an on/off signal.

8. The headphone of claim 1, wherein the user input provided by the ring comprises a volume adjustment signal.

9. The headphone of claim 1, wherein the user input provided by the ring comprises a mode selection signal.

10. The headphone of claim 1, wherein the first and second regions of the ring are defined relative to the housing, and do not vary relative to the housing as the ring is physically rotated.

11. The headphone of claim 1, wherein the rotatable ring is a first rotatable ring, the headphone further comprising:

a second rotatable ring coupled to the housing and surrounding a second central portion of the housing, rotation of the second rotatable ring providing a second user input to the electronics;

wherein the first rotatable ring and the second rotatable ring are positioned such that they partially overlap; and the housing covers a first portion of the first rotatable ring that overlaps the second rotatable ring, and a first portion of the second rotatable ring that overlaps the first rotatable ring, such that second, non-covered portions of the first and second rotatable rings appear to form an elongated circle.

12. The headphone of claim 1, wherein the electronics cause the loudspeaker to output audible sounds in response to rotation of the ring.

* * * * *